US008049095B2

(12) United States Patent
Barbera

(10) Patent No.: US 8,049,095 B2
(45) Date of Patent: Nov. 1, 2011

(54) TRANSDUCER SADDLE FOR STRINGED INSTRUMENT

(76) Inventor: Richard Barbera, Staten Island, NY (US)

( * ) Notice: Subject to any disclaimer, the term of this patent is extended or adjusted under 35 U.S.C. 154(b) by 337 days.

(21) Appl. No.: 12/266,962

(22) Filed: Nov. 7, 2008

(65) Prior Publication Data

US 2010/0116123 A1 May 13, 2010

(51) Int. Cl.
*G10H 3/18* (2006.01)

(52) U.S. Cl. ..... 84/731

(58) Field of Classification Search ..... 84/731, 84/298, 730, 734

See application file for complete search history.

(56) References Cited

U.S. PATENT DOCUMENTS

| | | | | |
|---|---|---|---|---|
| 4,860,625 | A * | 8/1989 | Mathews | 84/731 |
| 4,867,027 | A * | 9/1989 | Barbera | 84/731 |
| 5,078,041 | A * | 1/1992 | Schmued | 84/731 |
| 5,218,159 | A * | 6/1993 | McClish | 84/731 |
| 5,410,101 | A * | 4/1995 | Sakurai | 84/731 |
| 5,817,966 | A * | 10/1998 | Fishman | 84/731 |
| 6,255,568 | B1 | 7/2001 | Dunwoodie | |
| 6,822,156 | B1 * | 11/2004 | Lazarus et al. | 84/731 |
| 7,230,174 | B1 | 6/2007 | Wilson | |
| 7,394,015 | B2 * | 7/2008 | Takabayashi | 84/731 |
| 2002/0157523 | A1 * | 10/2002 | Takabayashi | 84/731 |
| 2004/0105560 | A1 * | 6/2004 | Naniki | 381/190 |
| 2004/0134330 | A1 * | 7/2004 | Braun et al. | 84/298 |
| 2006/0219093 | A1 | 10/2006 | Urbanski | |
| 2007/0131082 | A1 | 6/2007 | Feiten et al. | |
| 2008/0011146 | A1 | 1/2008 | Dunwoodie | |
| 2009/0038461 | A1 * | 2/2009 | Dunwoodie | 84/298 |
| 2010/0116123 | A1 | 5/2010 | Barbera | |

FOREIGN PATENT DOCUMENTS

| | | | |
|---|---|---|---|
| EP | 1 717 795 | A1 | 11/2006 |
| KR | 10-0578076 | B1 | 5/2006 |

OTHER PUBLICATIONS

International Search Report and Written Opinion dated Jun. 22, 2010 of a corresponding International PCT Application.

* cited by examiner

*Primary Examiner* — Jianchun Qin

(74) *Attorney, Agent, or Firm* — Scully, Scott, Murphy & Presser, P.C.

(57) ABSTRACT

A saddle for a multi-stringed instrument couples to transducer elements, vibrations from plucked musical instruments strings. The saddle includes a top saddle portion, and a body portion beneath the top saddle portion having a plurality of integral cavities, each integral cavity in correspondence with a respective string defining a vertically compliant area of sensitivity beneath each string that couple the string vibrations to a flexurally responsive transducer element mounted within and mechanically coupled to a respective integral cavity. A first ground conductor is formed on a top body portion surface and on each opposing surface of the body portion; and a second conductor is embedded within the body portion. The first conductor and embedded second conductor have respective portions extending to each the integral cavity structure to provide electrical coupling points for electrically connecting the transducer element to the first and second conductors at each respective the integral cavity structure.

39 Claims, 9 Drawing Sheets

TRANSDUCER SADDLE FOR STRINGED INSTRUMENT

BACKGROUND OF THE INVENTION

1. Field of Invention

The present invention relates generally to stringed musical instruments. Specifically, the present invention relates to providing a transducer saddle system for a stringed instrument.

2. Background of Invention and Related Art

Acoustic stringed instruments typically comprise a hollow body portion coupled to a neck portion extending longitudinally from a side wall of the hollow body portion. Steel, nylon, or other materials are used to make strings that are stretched from the distal end of the neck portion to a point on the top surface of the body portion. At each end, the strings rest on raised bars made of a hard material such as hard plastic or ivory. In guitars, this raised bar is typically called a nut at the neck, and a saddle at the bridge. Each string on a stringed instrument, such as a guitar, is set to a fixed length and tension, the length being fixed between the nut and the bridge. The bridge is a device on the top surface of the body that receives the string and maintains the tension of the string. The bridge further interfaces the strings with body and transfers string vibrations to the guitar top, maintains proper height clearance of strings over the fretted neck, establishes scale length of vibrating string.

Acoustic stringed instruments can be amplified in several ways. A microphone may be placed in front of a sound hole formed on the top surface of the instrument. When plucked, the string vibrates in virtually all axes of direction in the plane perpendicular to the direction of the string. These vibrations are transmitted to the body via the bridge, resonate within the hollow body, and are emitted via the sound hole. The problem with using microphones is that the microphone picks up not only the sound of the vibrating string, but every other sound caused by playing the instrument such as string noise, bumps and taps, as well as ambient noise from other instruments etc. The microphone can further cause feedback by picking up noise from the instruments' vibrating top, which is further amplified by the surrounding speakers/amplifiers.

Also a microphone has a very limited volume range and is ineffective when competing with other amplified instruments.

Another technique involves the use of guitar pickups, in the form of electromagnetic coils, or and piezo-electric transducers. Typically, mechanically coupled acoustic guitar pickup designs employ various types of compressively sensitive transducer materials which are sandwiched between the guitar saddle and the surface of the instrument's bridge or bridge plate. Compressively mounted transducers beneath the saddle tend to have a characteristic pinched and compressed quality of sound. This approach yields little directional biasing or selectivity in the vibratory information that is picked up and amplified. Consequently on an acoustic instrument much micro-phonic noise is collected and amplified along with the desired "musical information". Micro-phonic noise occurs when a pickup systems axis of sensitivity is mechanically coupled to the instruments resonant top. This coupling sensitizes the entire resonant surface of the instrument through the transducer system, causing every bump or knock on the instrument to be amplified. Micro-phonic sensitivity also increases feedback sensitivity because certain resonant frequency sensitivities in the instrument top become magnified, causing an uncontrollable feedback loop when the amplified signal excites the instruments top and strings through sympathetic resonances. Micro-phonic sensitivity also tends to yield an amplified sound which is "unfocused and boomy," this occurs when sensitive resonant frequencies in an instrument overpower the rest of the spectrum.

What is needed is an amplification apparatus for a multi-stringed musical instrument that provides uni-directional sensitivity to vertical string vibrations. Additionally, what is needed is a pickup apparatus for a multi-stringed musical instrument which does not microphonocally sensitize the instruments resonant top so as to eliminate micro-phonic noise from the body of the instrument while remaining mechanically responsive to vertical string motion. Also, what is needed is a pickup apparatus for a multi-stringed musical instrument that senses each strings vibrational outputs individually with a high degree of isolation from adjacent strings. This to enable the balancing of the individual strings outputs relative to each other, and to perform this passively through the electro-mechanical calibration of the pickup structure, without relying on a multi channel, active circuit to balance the string output signals.

SUMMARY OF THE INVENTION

The purpose of this invention is to provide a highly efficient means of coupling to sensors, vibrations from plucked musical instruments strings. The present invention mechanically conveys vertical aspects of string vibrations to transducers by way of cavities within a saddle body beneath a string saddle crown that establish vertically compliant areas within the saddle. The vertically compliant areas beneath each string are mechanically responsive to vertical string motion. These areas couple the strings to transducers mounted within said cavities, and are selectively sensitive only to vertical string vibrations from the top of the saddle, beneath the string. The uni-directional sensitivity does not respond to vibratory information from beneath the saddle and is only sensitive from its top or positive Z axis direction. This eliminates the introduction of micro-phonic noise from the body of the instrument in the amplified signal. Isolating the vertical component of the string vibration further maximizes fidelity, clarity of sound and responsiveness. The cavities housing the transducers are arranged in alternating phase circuit relationships to avoid phase cancellation effects between the adjacent transducers.

In one embodiment, the present invention is a string saddle system for a multi-stringed instrument, comprising a top saddle crown portion spanning all tensioned strings of said multi-stringed instrument to support the tensioned strings and to receive vibratory energy there from, a body portion beneath said top saddle crown portion having opposing surfaces, said body portion having a plurality of integral cavities, each integral cavity formed in correspondence with a respective string to define a plurality of vertically compliant areas of sensitivity, each vertically compliant area of sensitivity extending vertically from said top portion to said cavity structure and extending horizontally as defined by a length of said integral cavity, each integral cavity including a flexurally responsive transducer element mounted therein for converting vibratory energy from said respective string to an electric signal, said vertically compliant area conveying a vertical component of said vibratory energy to said transducer element via a flexible coupling device.

The system further comprises a first conductor formed on said top surface and each opposing surface of said body, said first conductor having portions connecting a bottom surface location of said transducer device inside of first alternate integral cavity structures, and having portions extending from said top surface for connecting a top surface location of said transducer device inside of second alternate integral cavity structures to form a first conducting path, a second conductor embedded within said body portion having portion for connecting a first [top] surface location of said transducer device inside of said first alternate integral cavity structures, and portion for connecting a second [bottom] surface location of said transducer device inside of said second alternate integral cavity structures to form a second conducting path, wherein said first conducting path and second conducting path conduct electric signals from said transducer devices such that said transducer devices of adjacent integral cavities couple electrical signals of alternating phase relationships to thereby avoid phase cancellation effects between adjacent transducer devices via said first and second conductive paths. The first conductor formed on said top surface and each opposing surface of said body forms a ground plane, the formed ground plane shielding the embedded second conductor.

In another embodiment, the present invention is a string saddle kit for a multi-stringed instrument, comprising a plurality of individual string saddles, each saddle in correspondence with a respective string of said multi-stringed instrument to receive vibratory energy there from, each individual string saddle having a saddle top portion and a saddle body portion beneath said saddle top portion, each saddle body portion of an individual string saddle having opposing surfaces and a top surface, and having an integral internal cavity to define a vertically compliant area of sensitivity for receiving said vibratory energy, each integral cavity including a transducer mounted therein for converting vibratory energy from a respective string to an electric signal, said vertically compliant area of sensitivity providing a sensitized area beneath the string for collection and conveyance of vertical string vibratory energy to said transducer element.

Each saddle body portion of first alternate arranged individual string saddles of said plurality has a first conductor formed on said top surface and each opposing surface of said body, said first conductor having portions connecting a bottom surface location of said transducer inside of a corresponding integral cavity structure, and, a second conductor embedded within said saddle body portion having portion for connecting a first top surface location of said transducer element inside of a corresponding integral cavity structure, and wherein each saddle body portion of second alternate arranged individual string saddles of said plurality having portions of said first conductor extending from said top surface for connecting a top surface location of said transducer element inside of said corresponding integral cavity structure, and portions of said second conductor embedded within said body portion having for connecting a bottom surface location of said transducer element inside of said corresponding integral cavity structure.

Each saddle body portion further has a means interconnecting said first conductive portions of each said individual string saddle of said kit to form a first conducting path, and a means interconnecting said second conductive portions of each said individual string saddle of said kit to form a second conducting path, wherein said first conducting path and second conducting path conduct electric signals from said transducer structures such that said transducer structures of adjacent individual string saddles couple electrical signals of alternating phase relationships to thereby avoid phase cancellation effects between adjacently disposed transducer elements.

BRIEF DESCRIPTION OF THE DRAWINGS

Further features, aspects and advantages of the apparatus and methods of the present invention will become better understood with regard to the following description, appended claims, and accompanying drawings where:

DETAILED DESCRIPTION OF THE EMBODIMENTS

The present invention provides a stringed musical instrument pickup comprising a plurality of electromechanical structures that are integrated with a saddle or saddle segments. The saddle or saddle segments comprise articulated cavities beneath each individual string. A top saddle strip supports tensioned strings over a vertically compliant area of the cavity. The articulated cavities are part of a body portion beneath top saddle portion. The body portion has opposing surfaces. Each cavity includes a flexurally responsive transducer element suspended between two mounting points, or suspended at one end from one mounting point. Each transducer element is mechanically and electrically coupled at coupling points via conductive elastomer pads or using a conductive mounting agent such as a conductive epoxy. In alternate embodiments, the transducer element is mechanically coupled at separate mechanical coupling points with electric coupling provided at separate electrical coupling points. The vertically compliant area of the cavity provides a vertically biased area of sensitivity within the saddle/saddle segment corresponding to each string. Vertical displacement of this area of sensitivity below the saddle is transmitted to the horizontally suspended transducer via the pad. The transducer converts this displacement from vibratory energy to an electric signal for each respective string, and is driven by the relative differential in mechanical input between the coupling to the area of sensitivity via the elastomer pad, and the rigid mounting ledges. In one embodiment, the saddle is of a laminated construction and contains four layers of circuit paths. Positive (embedded layer) circuit paths and negative (outside surface layer) circuit paths index to precise points in the body structures corresponding to the mounting and conducting points, and determining the phasing arrangement of the transducers.

First Embodiment

Figure 1:
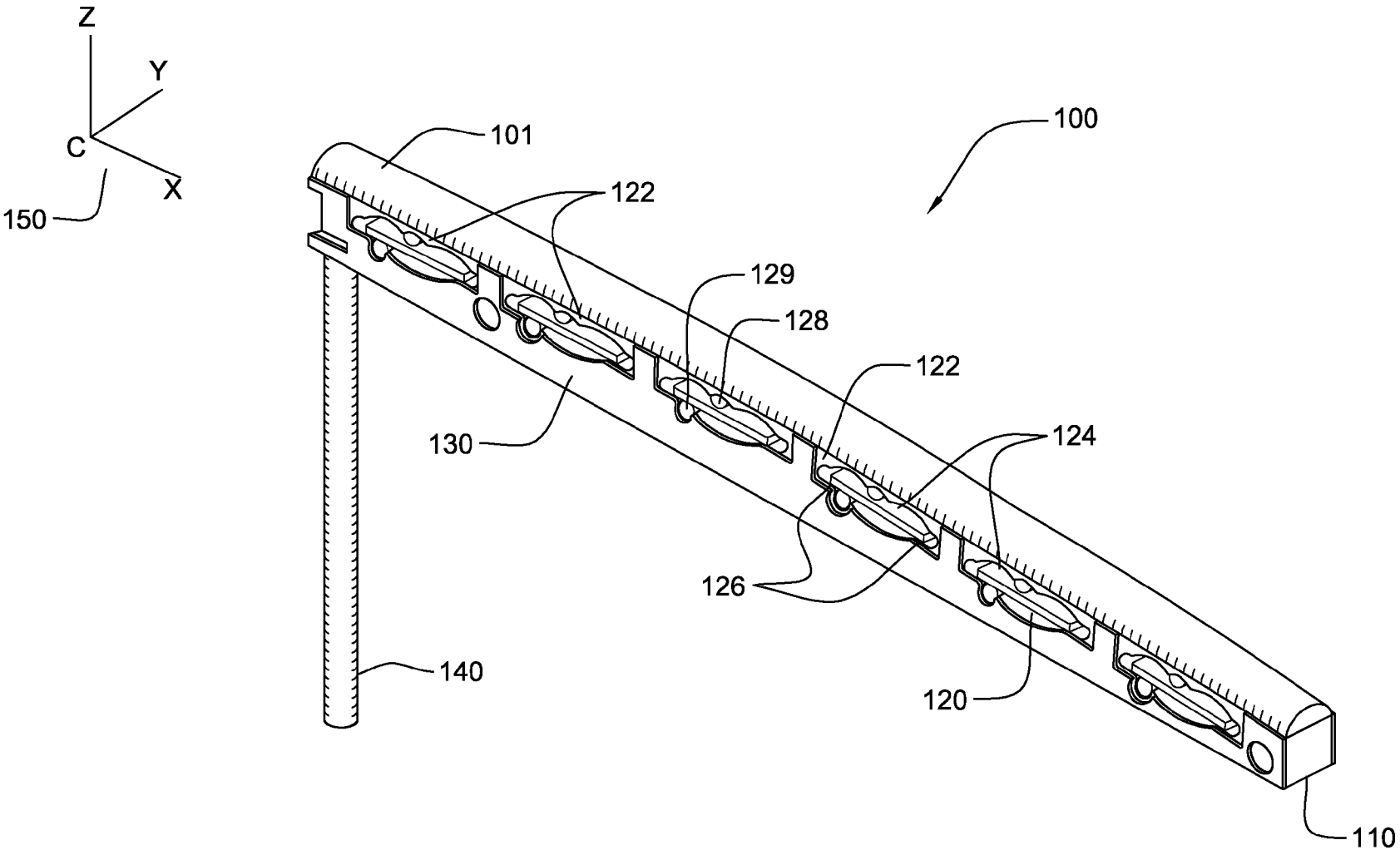
FIG. 1 shows a unitary string saddle system according to an exemplary embodiment of the present invention.

FIG. 1 shows a unitary string saddle system 100 according to an exemplary embodiment of the present invention. Top saddle strip 101 supports the tensioned strings (not shown) over the body portion 110. Body portion 110 comprises a laminated construction of printed circuit board or like materials, or may comprise similar structures for embedding a circuit path of conductor material such as copper. Within the body portion there is further included a plurality of embedded cavity structures 120 located in articulation with a respective string. In the embodiment depicted, there are 6 cavity structures 120; one for each string on a six-string musical instrument such as a guitar. The body portion 110 also comprises two opposing surfaces described in further detail in the following figures. Cavity structures 120 define and form a vertically compliant area of sensitivity 122 in the body portion that is responsive to vibratory energy from the corresponding string. Each vertically compliant area 122 extends vertically from the top saddle strip 101 beneath the respective string to top of cavity structure 120, and extends horizontally as defined by the length of the cavity structure 120.

Figure 2:
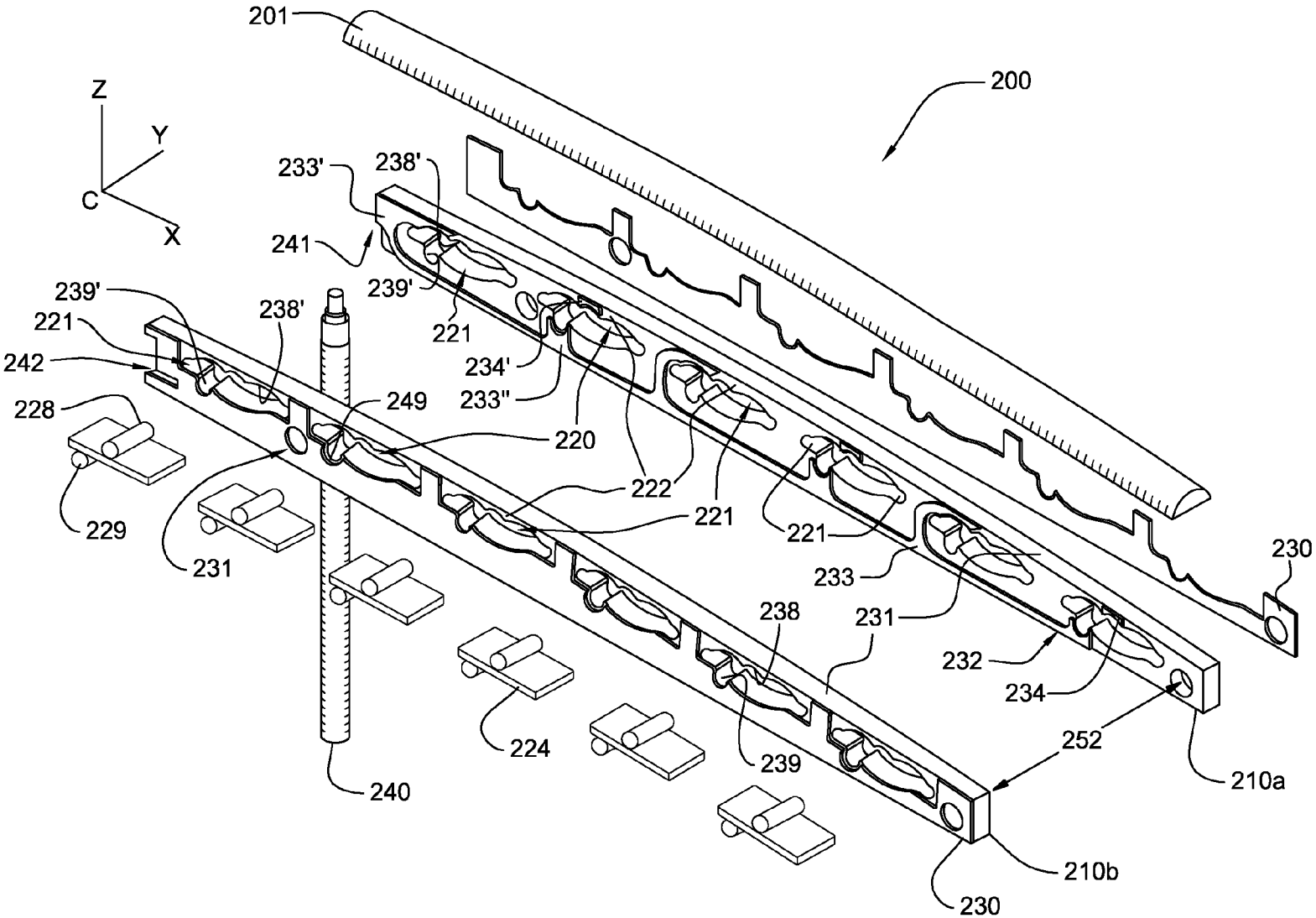
FIG. 2 shows an exploded view of the string saddle system shown in FIG. 1.

The sensitivity of the vertically compliant roof area of the cavity can be increased or attenuated via the thickness of the roof section of each cavity. In addition, sensitivity is adjusted by the thickness (rigidity) of the top saddle strip. Moreover, as shown in FIG. 2, and, in greater detail in FIGS. 5A-5C, horizontal elongation slots 227 are provided on either or both sides of each cavity 220 which adjusts the degree of vertical sensitivity for the cavity/vertically compliant area of sensitivity. This enables passive electro mechanical balancing of the string outputs relative to each other.

Each cavity structure 120 further includes a flexurally responsive transducer element 124, which is suspended in a beamlike fashion between mounting points 126 formed within a lower surface of each cavity. In example embodiments, the flexural transducers include bender, or bimorph type transducer elements which are a laminate of two piezo ceramic plates with a metal center vane sandwiched between them. Bender or bimorph type transducers are designed to be excited flexurally as opposed to by compression (which is what is typically used for plucked stringed instrument pickups). A unimorph type transducer could also be employed, which is one piezo plate laminated onto one side of a piece of brass. Basically any type of rigid, flexurally responsive transducer element which can be mounted in a beam or cantilever fashion, with exposed, polarized conductive electrodes on its opposing surfaces, could be employed in this structure.

As shown in FIG. 1, transducer element 124 is mechanically and/or electrically coupled at coupling points by conductive elastomer pads 128 and 129 which may comprise sections of extruded, conductive rubber cord. or, by an equivalent conductive mounting means, e.g., a predetermined amount of conductive adhesive material, e.g., a conductive rubber glue or soft cure conductive epoxy of suitable viscosity and durometer. Conductive layer 130 formed on opposing surfaces of body portion 110 is one among a plurality of conductive elements forming positive and negative circuit paths, further described in subsequent figures. Bisected holes pass through the embedded circuit paths and also meet the external ground planes 130 on the outside faces of the body portion, thereby exposing positive and negative circuit contact points within the holes, as seen in FIG. 2. A shielded audio cable 140 is affixed to the saddle system with adhesive and the positive and negative connections are made to their respective contact points via solder or conductive adhesive.

The top saddle strip 101 is the load bearing part of the structure that supports a tensioned string of an instrument. The saddle 101 thus transmits vibrations induced in the string of the instrument to the respective vertically compliant area 122 of the saddle body portion immediately below. The vibrations may be induced by plucking the string, bowing, or any other means. The cavity 120 in the body portion 110 is in essence an elongated slot. The physical dimensions of this slot 120 are dictated by the size of the saddle, depending upon the type of stringed instrument in which it is installed. Generally, the more elongated the cavity 120, the more sensitized the vertically compliant area 122. In other words, string to string output balances may be calibrated mechanically by elongating the individual articulated cavities 120 horizontally. This increases the degree of vibratory compliance of the individual vertically compliant area and thus increases the amount of vibratory energy conveyed to the associated transducer 124. The result is louder output for that particular string. The optimal size is a balance between sensitivity and structural integrity (to protect the delicate transducer element within) and will be evident to one skilled in the art, depending on the appropriate application.

The upper pad 128 of the two small, conductive elastomer pads mechanically couples a point on the underside of the vertically compliant area 122, to a point on the suspended transducer 124 below. In one embodiment, the pad 128 is nested and compressed into the vertically compliant area of the saddle. In another embodiment, the pad 128 is compressed between a ramped roof area on the underside of the vertically compliant area of the saddle. The upper pad thus mechanically couples the vertical area of sensitivity 122 to the horizontally suspended, flexurally responsive transducer element 124. The upper pad additionally provides electric coupling of the top surface of the transducer element to a positive (or negative circuit path depending on the phasing of the adjacent transducers), as shown in FIG. 2. This helps to avoid phase cancellation effects between adjacently mounted transducer elements. Alternate phasing is necessary to avoid phase cancellation effects between adjacent strings which is a common practice in the art when multiple transducers are employed.

Figure 5A:
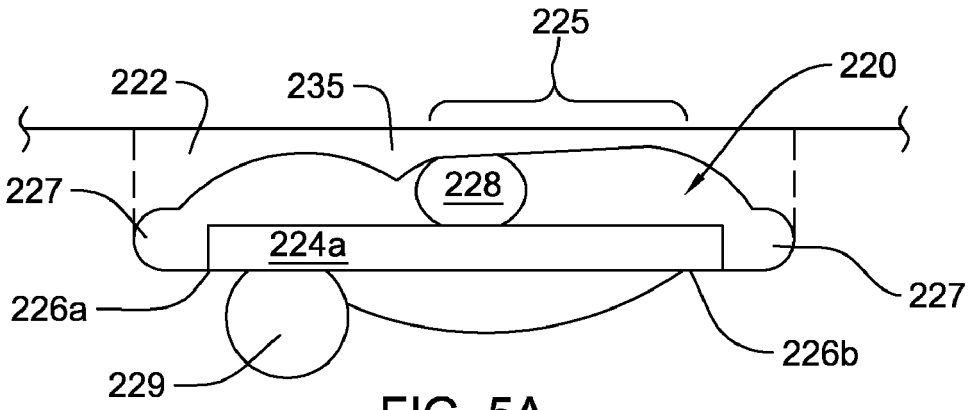
FIGS. 5A-5D illustrate more detailed views of the cavity structure 220 and various methods for electrically and mechanically coupling the transducer element 224 within each cavity.
Figure 5B:
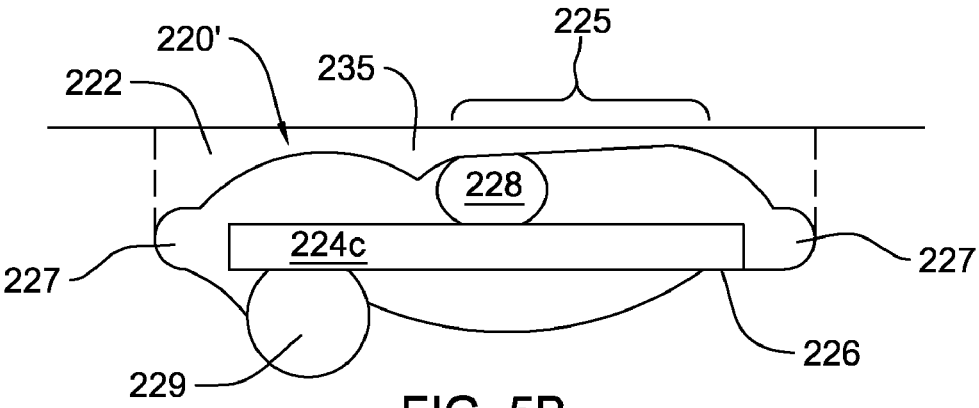
Figure 5C:
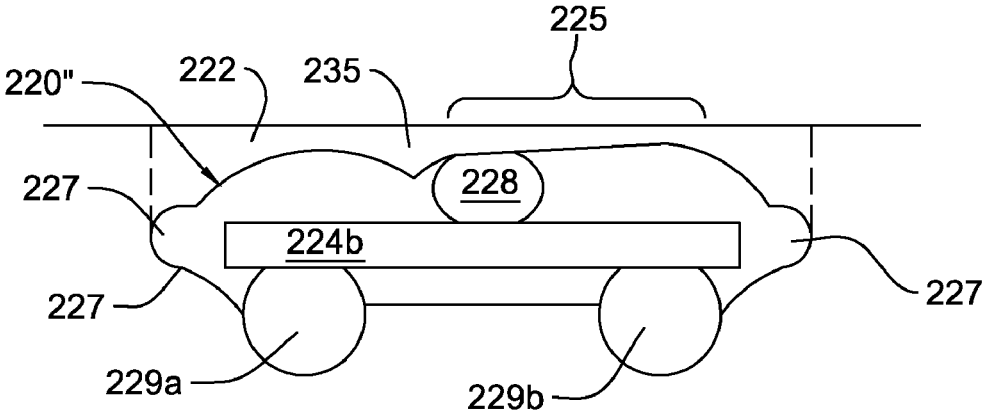

The lower of conductive elastomer pad 129 also makes an electrical connection between the bottom face of the transducer and the ground/negative plane or to the positive circuit path depending on the phasing of the transducer 124. The lower pad is only an electrical coupling in the optimal embodiment. The lower pad does not have to mechanically couple the transducer to any vibratory input. In an alternate embodiment, as shown in FIGS. 5A-5C, the lower pad(s) could function as a soft ledge, supporting one or both end(s) of the transducer in place of the rigid ledge(s). The negative electric coupling is provided to alternate cavities, as shown in FIG. 2.

The transducer elements 124 receive vibratory energy from the vertically compliant area of sensitivity via the mechanical coupling provided by the upper elastomer pad 128, and convert the vibratory energy to electrical energy. The transducer is driven by vibrations from the vertically compliant area via the coupling pads. The transducer is essentially responding to the relative differential in mechanical input between the coupling to the area of sensitivity via the elastomer pad, and the rigid mounting ledges in one embodiment. In one embodiment, shown in FIG. 1, the transducer element is mounted between the two rigid mounting ledges 126.

FIGS. 5A-5C illustrate more detailed views of the cavity structure 220 and various methods for mounting of the transducer 224. As shown in FIG. 5A, the lower inner cavity surface includes two rigid ledges 226*a* and 226*b* upon which the transducer element 224 is beam mounted, i.e., ledges provides the bottom mechanical coupling to the cavity. In the embodiment depicted, the coupling pads 228, 229 only provide electrical coupling of the transducer to the circuit paths.

In FIG. 5B, the lower inner surface of cavity structure 220' includes a single ledge 226 upon which the transducer element 224 is cantilever mounted, i.e., provide cantilever support because it is anchored on one end to a rigid surface (ledge 226). In the embodiment depicted, the coupling pads 228, 229 provide electrical coupling of the transducer to the circuit paths. However, in this embodiment, only one rigid transducer mounting ledge is provided and a bottom coupling pad 229 provides a soft support beneath the cantilever mounted transducer. Top elastomer conductive pad 228 provides mechanical coupling to the vertical compliant areas 222, and further electrical coupling to a circuit path as will be described herein below.

In FIG. 5C, the lower inner surface of cavity structure 220" has eliminated the rigid ledges upon which the transducer element 224 is mounted; rather, the transducer element is beam suspended upon two bottom mounting pads 229*a*, 229*b*. In this embodiment, both the bottom coupling pads 229*a*, 229*b* provide soft support beneath the beam mounted transducer. One or both of these pads additionally provide electrical coupling to the circuit paths as will be explained in greater detail herein. Top elastomer conductive pad 228 provides mechanical coupling to the vertical compliant areas 222, and further electrical coupling to a circuit path.

The saddle system, by way of its internal cavity structures is directionally sensitive to vertical string vibrations conveyed along a single axis, e.g., on its positive Z axis. It is highly desensitized to vibrations from below, or negative Z axis direction. There is also very little sensitivity on the X and Y axis because the rebated areas in the saddle, on both sides of each vertically compliant area isolate the sensitized vertically compliant areas from the walls of the saddle slot, and the sensitized, receptive area of the suspended transducer is coupled only to the isolated vertical compliant area. So only vertical vibrations are sensed. This directional sensitivity decouples the pickup system from the top surface of the body of the instrument, thus providing a non micro-phonic relationship to the resonant instrument top. The lack of microphonic sensitivity reduces feedback and eliminates the amplification of spurious body noise from handling of the instrument. This yields a very clear, and focused sounding audio signal from each string.

Figure 6:
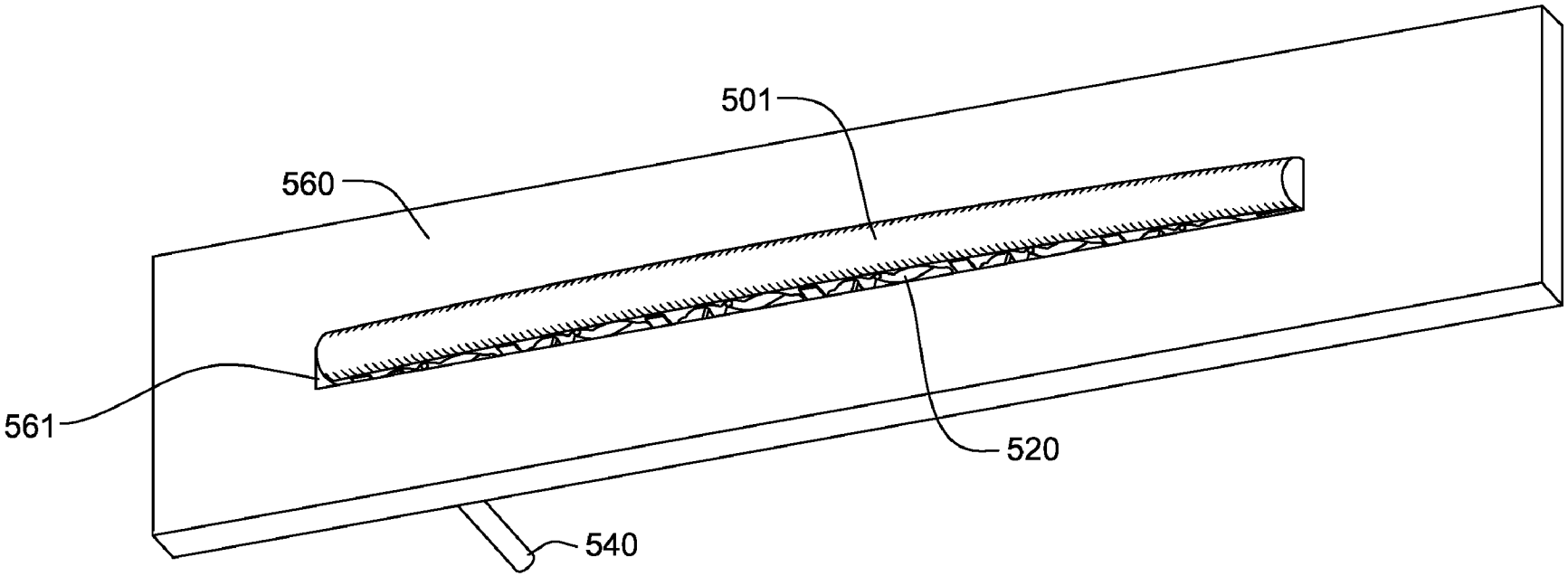
FIG. 6 shows a unitary string saddle system placed within a saddle plate slot, according to an exemplary embodiment of the present invention.

In addition, the front and back face of each vertically compliant area are free to vibrate by way of clearance pockets on the front and back face of the saddle corresponding to the areas of sensitivity. These rebated areas prevent the sensitized areas of the structure of the cavity from contacting the sides of the slot in the saddle plate in which the saddle is mounted, as shown in FIG. 6. This prevents the sensitized areas from being mechanically damped by being forced against the walls of the saddle slot from the forward pressure from the tensioned strings. The rebated areas also decouple the areas of sensitivity from the walls of the bridge plate saddle slot.

FIG. 2 shows a detailed exploded view of the components of the saddle system depicted in FIG. 1. As described earlier, string saddle 201 supports tensioned strings (not shown) over a body portion, comprising two portions 210. The bottom surface of string saddle 201 is coupled to the top surfaces of body portions 210 that, in one embodiment, comprise single PCB layers 210*a*, 210*b* that when mated form a unitary body portion of laminate construction having internal cavities 220 and embedded circuit portions therein. Each body portion 210*a*, 210*b* further comprises, apart from the top surface, an outer and an inner surface. A grounding plane 230 is attached to the top surface and outer surfaces of each body portion 210*a,b*. For the needs of this circuit, one embedded inner circuit path is preferable; that is, body portions 210 include an imbedded (or laminated) positive circuit path 232 for electrical coupling to said transducer with negative (e.g., ground) circuit path contacts 234 provided within the cavity structure at alternating string positions for coupling to said transducer. These circuit paths are further described below.

Body portions 210*a,b* further comprise a plurality of cavities, two of which are represented by 220. The cavities, by way of their structure, define and form a vertically compliant area of sensitivity 222 for each respective string. Transducer elements 224 are mounted within the cavities, held in place by mounting points in a beamlike fashion, and are electrically and mechanically coupled to the top and bottom surfaces of the cavity. Additionally the transducers may be glued or epoxied in place at one or both ends to the mounting points, i.e., cavity bottom inner surface ledges. In one embodiment, the mounting points are located at ledge portions formed along the horizontally elongated cavity. The top surface of a transducer element 224 is mechanically coupled to the bottom surface of the vertically compliant area 222 of the cavity housing the transducer element via conductive elastomer pads including bottom pad 228 and top pad 229. In one embodiment, the pads are fitted into respective bisected holes or mounts 239 and/or arch shaped (e.g., concave) nest 238, located and formed as part of the lower bottom inner cavity surface (pad 239) and upper inner cavity surface (pad 238). However, as described in greater detail herein with respect to FIGS. 5A-5C, the inner top surface of each cavity is ramped to enable adjustment of compression on and position of top coupling pad.

Figure 5D:
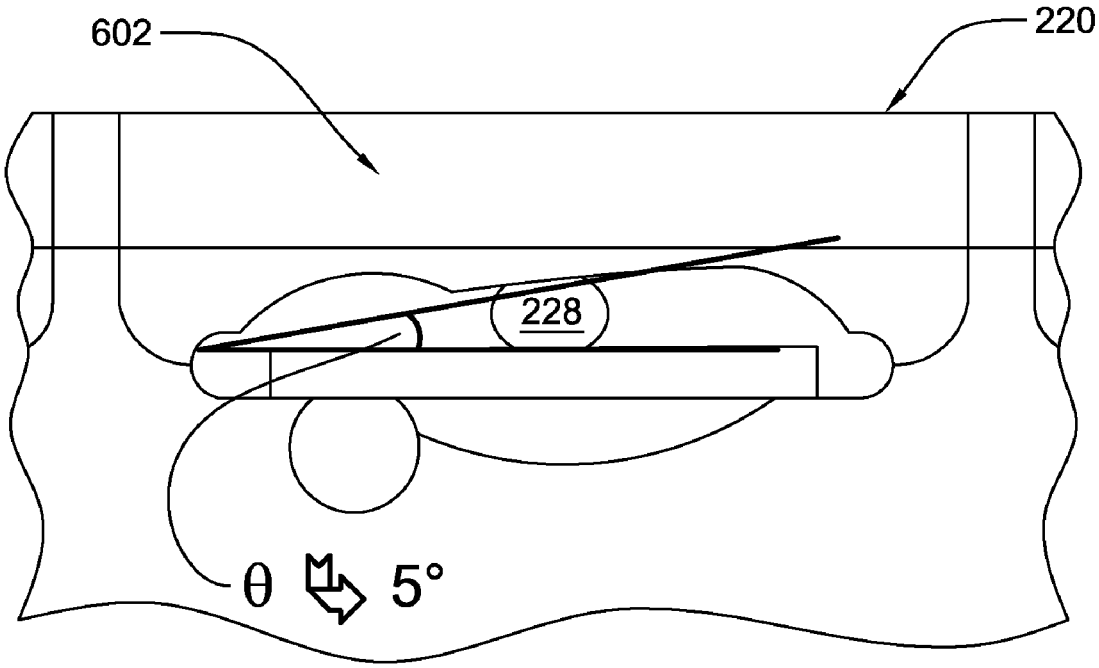

That is, in each of the embodiments described in connection with FIGS. 5A-5C, rather than an arch shaped nest 238 for accommodating mounting of the top coupling pad the roof (as shown in FIG. 2), each of the cavities may include a ramped shape top roof portion 225 that includes a half radius 235 which acts as a stop. This allows for some adjustment of the degree of compression of the top coupling pad 228 that electrically and mechanically couples the transducer element 224 within the cavity. The angle of the cavity roof ramp relative to the transducer top horizontal surface ranges anywhere between about 2.5 to 7 degrees relative to the top transducer surface. FIG. 5D illustrates a detailed view of the cavity structure 220 showing the angle of the cavity roof ramp relative to the transducer top horizontal surface as about 5 degrees. It is understood that an optimal angle will depend on the diameter or size of the coupling pad, the durometer of the elastomer of the pad and the degree of coupling/compression needed in order to achieve the desired level of output performance. In one embodiment 0.060 diameter pads may be used. A steeper angle will obviously increase the degree of compression of the pad however, a balance is struck here because too much compression may break a suspended transducer element.

Preferably, each top ramped roof portion is coated with a conductive paint to increase the conductive surface area between the embedded circuit (at the electrical contact point) and the conductive pad.

Figure 3A:
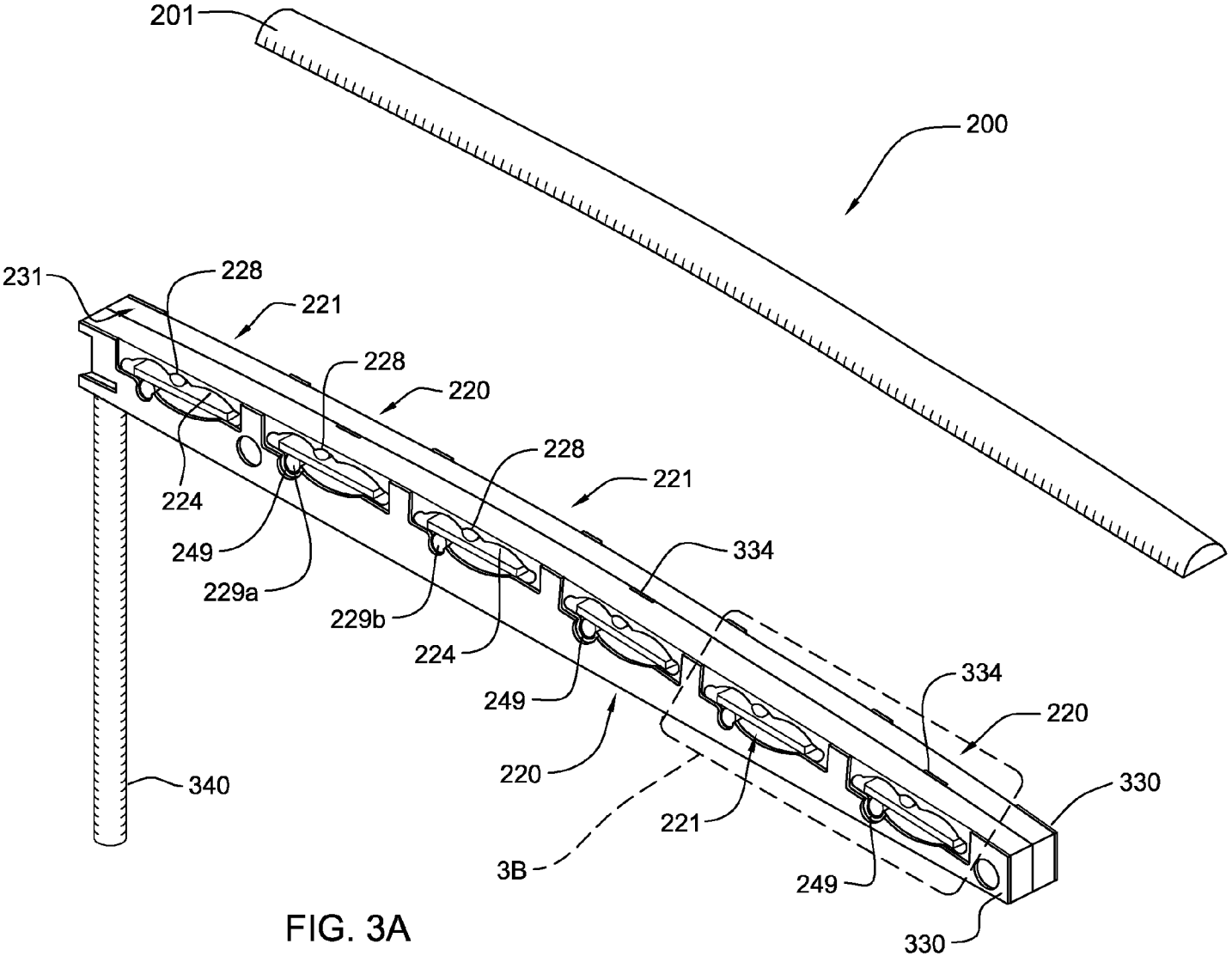
FIG. 3A shows a partially assembled view of the string saddle system shown in FIGS. 1 and 2.

As shown in FIG. 3A, each transducer element 224 in each cavity has a connection to both the positive and negative circuit paths via top conductive pad 228 and bottom conductive pad 229 in alternately phased configuration. Thus, the bottom conductive pads couple a bottom transducer surface to either a negative or a positive connection at respective alternate cavities, and, likewise, the top conductive pads couple a top transducer surface to positive or a negative positive connection at respective alternate cavities.

More particularly, in accordance with the present invention, as shown in the exploded view of FIG. 2, the saddle system includes four layers of circuit paths. There is an embedded positive polarity circuit path 232 containing positive contacts 233. There are three negative circuit paths that also act as ground planes for EMI shielding. Ground planes 230 are deposited or formed onto the outside surfaces of the body portions 230, and ground planes 231 are deposited or formed onto the top surfaces of the body portion. The ground planes 230 and 231 formed on the top surface and each opposing surface form a shield in the form of a Faraday cage, providing a shield from electromagnetic interference. The bottom surface of the body structure 210 may also be coated with a conductive coating to increase the faraday cage shielding effect. As further shown in FIG. 2, the saddle system includes embedded negative contacts 234 for coupling top coupling pad structures of alternate cavities to the ground plane for respective alternate strings. In one embodiment, the embedded positive conductor and negative ground planes are formed of copper, brass or a like conductive material. In one embodiment, the entire outside conductive surface (ground plane) may actually be a shaped conductive (copper or brass) shim bonded to the saddle body surface instead of being machined from the surface.

The positive and negative circuit paths index to precise electrical coupling points in each cavity structure which correspond to the locations of the coupling pads for electrically coupling (and/or mounting) the transducer element in the cavities and determine the phasing arrangement of the transducers. Referring to a first cavity 221, as shown in FIG. 2, it is observed that, in one example embodiment depicted, embedded positive circuit path 232 in body portion 210*a* includes a contact portion 233' for electrically coupling the upper conductive elastomer pad, i.e., pad 228 in mounting structure 238', coupled to the corresponding transducer element 224 at a first (top) transducer location. Further, the negative circuit path (ground plane) 230 of outside body portion 210*b* will be in contact with the lower conductive elastomer pad, i.e., pad 229 in mounting point 239', which is not rebated, and coupled to the same transducer element at a second (bottom) transducer location. In other words, transducer in cavity 221 has its top surface positively coupled and bottom surface grounded to side wall 230 by virtue that this mounting point is not a rebated edge as shown in FIG. 3A. This configuration is similar for alternative cavities 221 shown in FIGS. 2 and 3A.

Conversely, it will be observed that the immediately adjacent (neighboring) cavity 220 has a negative circuit path contact 234' in contact with the bisected hole (conductive pad nest structure) for an upper conductive pad coupled to the respective transducer element at a first (top) transducer location. Negative circuit contact 234' is in contact with ground plane 231 (and outside surface ground plane 230, since all ground planes are at the same potential). Further, it will also be noticed that embedded positive circuit path 232 includes positive circuit connection 233" that is in contact with the bisected hole (conductive pad nest structure) corresponding to the lower conductive pad 229 coupled to the respective transducer element at a second (bottom) transducer location. In other words, transducer element 224 in cavity 220 has its top surface grounded and its bottom surface coupled to the positive circuit path. Note that at this cavity, the outer ground plane 230 includes a rebated pocket 249 to prevent the lower conductive pad 229 from shorting the outside conductor (e.g., negative ground plane). This configuration is similar for alternative cavities 220 shown in FIGS. 2 and 3.

Figure 3B:
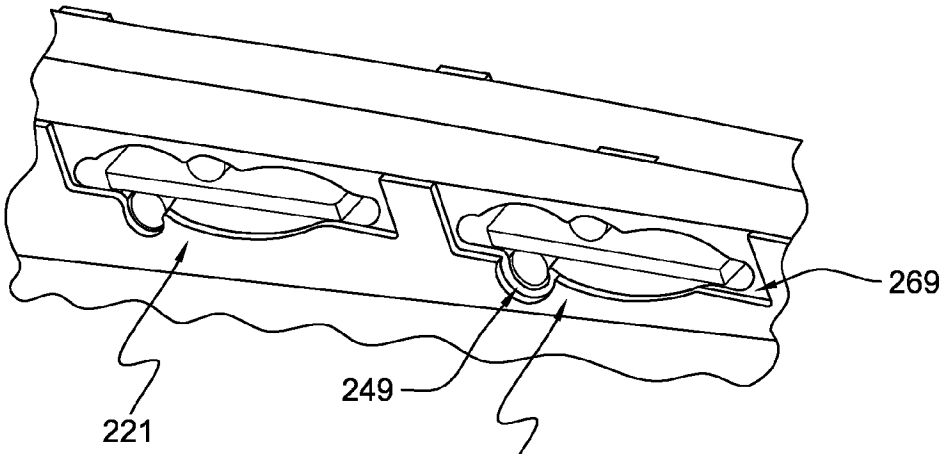
FIG. 3B shows a detailed assembled view of a string saddle cavity depicting small rebated pockets to prevent short circuiting of the transducer element therein.

FIGS. 3A and 3B further depicts two adjacent cavities 261. As shown in the detailed view of FIG. 3B, in the design of each cavity, small rebated areas 269 are provided beneath the ledge surfaces where the transducer device rests on the ledge, these small rebated areas 269 are in conjunction with the alternating lower rebated areas 249 which isolate the lower coupling pads and further prevent short circuiting of the bottom of the transducer with the outside ground plane surfaces.

With respect to the rebated pocket, in order to prevent a short circuit, the bottom conductive pads electrically coupling the transducer to the positive (embedded) circuit path (e.g., pad 229*a* shown in FIG. 3A) have a rebated edge or pocket 249 on the outside walls around the perimeter of the bisected holes to isolate the positively coupled pad 229*a* (coupled positive via the imbedded circuit path) from the negatively charged ground plane walls 330 on the outside surface of the mated body portions. That is, the rebated clearance pockets 249 around the perimeters of the bottom, positively phased coupling pads 229, i.e., the clearance between the positive pads mount and the negative external wall ground plane is necessary to prevent the shorting out of the circuit for alternative cavities 220 shown in FIG. 3A. Inversely, at each alternate cavity 221, the bottom pads electrically coupling the transducer to the negative circuit path via the outside wall ground planes 330 do not have the rebated edge as shown in FIG. 3A.

In general, referring back to FIG. 2, subsequent cavities follow this configuration whereby transducer elements in alternating cavities are coupled to positive and negative circuit paths in alternating phase relation. Following this relationship as shown in FIG. 2, for example, a next cavity (a third cavity 221) would have a top surface of the transducer coupled to embedded positive circuit path 232 and the bottom surface of the transducer coupled to the negative circuit path 230 (grounded). Conversely, the fourth cavity 220 would have the top surface of the transducer coupled to the negative circuit path 230 (grounded) and the bottom surface coupled to the embedded positive circuit path 232. This alternating transducer electrical coupling arrangement repeats for every transducer below every string on the instrument in adjacent cavities to help avoid phase cancellation effects between adjacently mounted transducer elements.

Moreover, as transducer and other pickups are generally sensitive to magnetic fields generated by transformers, fluorescent lamps, and other sources of interference, pickup hum and noise generated from these sources are eliminated. That is, according to the invention, the transducers in the present embodiment are electrically shielded (such as by a Faraday shield formed by the ground conductors on outer body portion surfaces and on surface top), signals (i.e. signals such as hum) are eliminated. Furthermore, since only vertical components of string vibrations are detected along the Z-axis by the vertically compliant areas, other vibrations from the body of the instrument or string noise are not picked up.

In one embodiment, the body portions 210*a,b* can be constructed from a lamination of copper clad printed circuit board (PCB) material or any other suitable substrate material upon which a conductive layer or skin is attached to the surfaces. The ground/negatively coupled layer is clad on both outside surfaces with copper or an equivalent conductive layer, and the positively coupled lamination layer is clad the inside surfaces of body portions 210. The body portions are then laminated together with an adhesive, with the positive circuit paths sandwiched inside, while the ground planes on the top, outer sides and (optionally) bottom surfaces provide Electromagnetic Interference (EMI) shielding of the embedded positive circuitry. The laminated body portions may be indexed together with pins. Particularly, as shown in FIG. 2, indexing pin holes 252, 253 are provided that extend through the laminated body portion plates for precision alignment of the second conductor to coupling points in said integral cavity structures.

Figure 7:
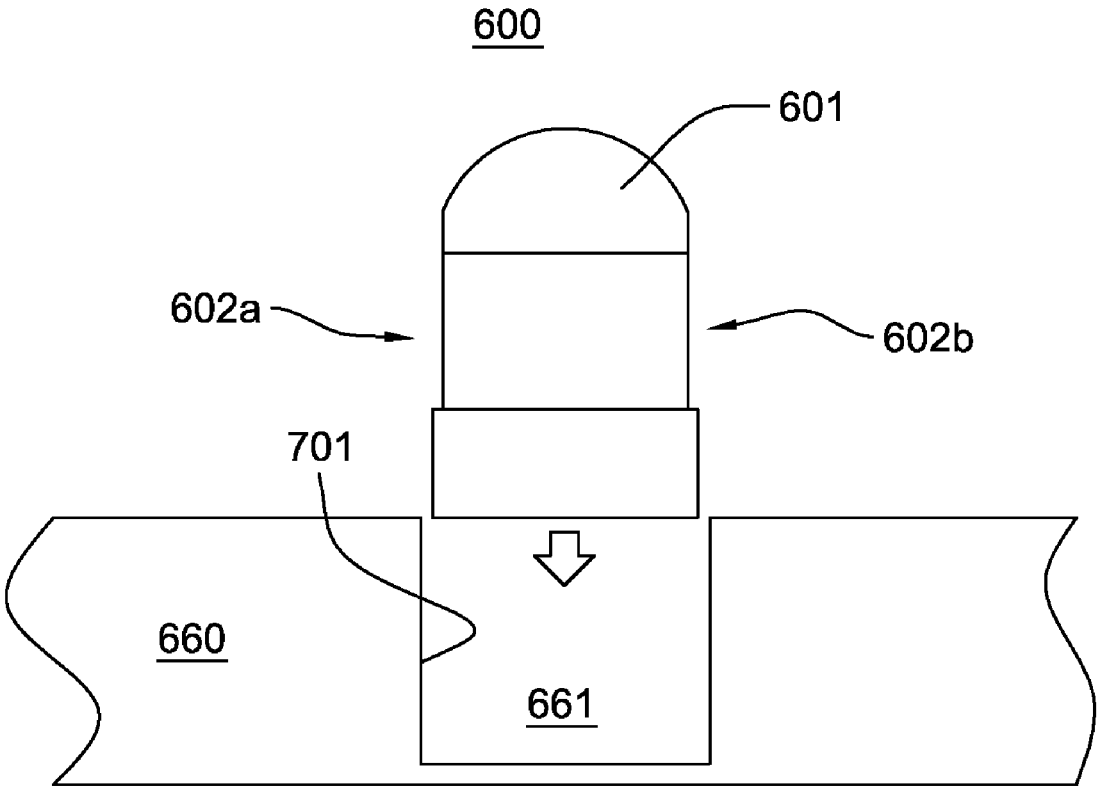
FIG. 7 depicts a side cross-section view of the saddle body, which may be of unitary structure, that is situated for mounting within a mounting slot including an opening formed at a surface of the multi-stringed musical instrument.

In one exemplary embodiment, as further shown in FIG. 2 and in greater detail in FIG. 7, the defined vertical area of sensitivity 222 at each outer body portion surface is rebated to provide clearance in a mounting slot when the saddle is mounted in an aperture on the stringed instrument. Clearance pockets in the front and back face of each cavity's vertical area of sensitivity maintain physical clearance for unimpeded vertical sensitivity. This rebated pocket also isolates the positive top coupling pad and its mounting area from the negative external groundplane. The mechanical clearance for the vertical area of sensitivity could also be achieved using vertical shims (not shown) instead of rebate pockets. That is, shims may be provided on the front and back faces of the saddle, in the same locations as the non-rebated areas. However there would still need to be some rebating around the areas of the positive top coupling pads to maintain circuit integrity and no shorting between positive top pad areas and negative ground plane.

The top saddle strip 201 is adhered onto the body structure with glue, i.e., a conductive epoxy. The electric connection between the conductive epoxy ground plane and the side ground planes on the main body occurs at the non rebated areas where the side ground planes on the main body meet the underside of the top saddle strip that has the conductive epoxy adhesive layer. The conductive adhesive ground plane layer under the saddle strip also connects the side ground planes on the body structure to embedded negative contact points 234, 234' for the conductive elastomer pads beneath the saddle strip.

In one embodiment, as described, bisected holes in the transducer support ledges clasp conductive elastomer pads. Conductive paint is applied to the insides of the holes to increase the conductive surface contact area. In the case of the bottom negative connections the conductive paint extends the negative outside ground planes circuit path into the inner surface of the bottom negative containment structures. In the case of said second electrical coupling points inside of said second alternate integral cavity structures, the conductive paint extends within the electrically indexed containment structure to contact the first conductor on opposing body surfaces.

The conductive elastomer pad, contacting a conductive surface coating, is clasped in the holes within each cavity and makes electrical contact with the internal (positive) and external (negative) circuit paths. The conductive pads are situated transverse with respect to the length of the body portion, and extend slightly out of the top of the supporting structure (nest or ledge) and beyond the surface of the ledge. The transducer rests upon the ledge where the clasped elastomer pads are exposed, thereby making the appropriately phased electrical contacts to the electrode surfaces of the transducer. In the embodiments depicted in FIGS. 5A-5C however, the angle of the cavity roof ramp relative to the horizontal transducer surface and the durometer of the elastomer of the pad determines the degree of coupling/compression needed in order to achieve the desired level of output performance. It is understood that different size and durometer pads may be implemented in different cavities of the same saddle to further balance the various string outputs.

As further shown in FIG. 2, the body portions provide a notched slot (not shown) or like recess for accommodating connection of a shielded cable 240 that is affixed to the saddle system with adhesive and the positive and negative connections are made to their respective positive and negative circuit paths contact points via solder or conductive adhesive. The respective contact points may be incorporated into the body portion of the musical instrument in the form of an output jack for receiving a dual-polarity output connector to transmit the signal via an instrument cable. As shown in FIG. 2, there is illustrated a further cable mounting pocket 241 running from a bottom surface of the body portion to an exposed internal circuit soldering point for routing of external connector cable to an internal connecting point. Particularly, a pocket 241 is machined at one end of the body portion of the saddle that exposes embedded internal positive conductor (positive circuit path) for accommodating connection, e.g., by soldering, to a positive polarity output cable 240 connection. Additionally, there is machined a notched slot 242 in end of the body portion of the saddle for routing of aground connection from cable 240 to external ground plane on exterior outside saddle body surface. Although not shown, shielded output cable 240 can be coupled directly via the output jack to an external amplifier/high impedance pre-amplifier circuit or signal processor. Additional pre-amplifiers may be incorporated within the body of the instrument before outputting the signal from the transducers to an external amplifier/processor.

FIG. 3A shows the exploded saddle system of FIG. 2 as a partially assembled saddle system 200, according to an exemplary embodiment of the present invention. As shown, ground plates 330 extend to the top surface of body portion 210. Also, negative circuit contacts 334 extend to the top surface. Body portion top surface ground plane 231 in FIG. 2 connects all the negative contacts 334 to a ground potential. The alternating arrangement of grounding lower and upper elastomer pads is also represented.

For the above-described embodiments, the top of the saddle may be shaped as desired to accommodate the strings. For instance, classical guitars do not have a radius in the saddle, and the saddle is flat with no arc. The figures show a top saddle strip that is horizontally aligned along an axis, with the integrated cavities being in corresponding horizontal alignment. However, the top saddle structure may be arcuate shaped, to correspond to the radius of the fretboard of the stringed instrument with the integrated cavities being aligned according to said arcuate shape. Further, the height of the entire structure of the multi transducer saddle may be shimmed from beneath to adjust the overall height. Alternatively, a height-adjusting means may be provided in the form of adjustment screws, or equivalent. This adjustment means may be incorporated into a saddle plate for holding the saddle, the saddle plate being represented in FIG. 7.

Figure 3C:
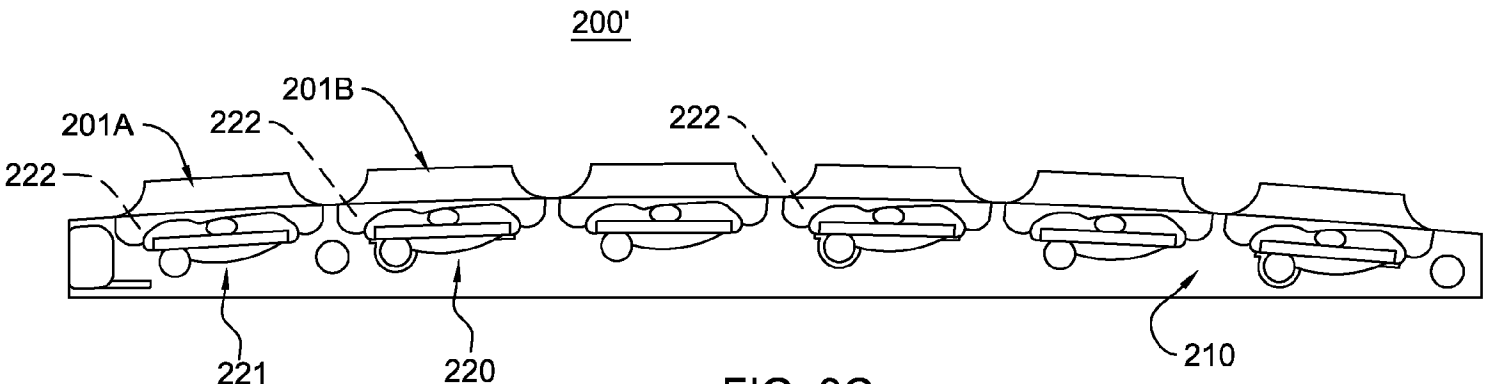
FIG. 3C shows a front elevation view of the string saddle system 200 having a segmented saddle top portion including individual top saddle portion segments.

As a further modification to the embodiment of FIG. 3A, the top saddle strip portion 201 spanning all the cavities in the first embodiment as shown in FIG. 3A, is segmented into individual saddle segments, a top saddle portion segment for an individual string. In this alternative embodiment as shown in FIG. 3C, saddle 200' includes a top saddle strip that is divided into separate individual top saddle strip portions 201A, 201B, . . . etc., in correspondence with a respective string (not shown) over the body portion 210 which may be of unitary or stacked circuit board design (as shown in FIG. 3A). In the embodiment depicted in FIG. 3C, each top saddle strip segment supports an individual tensioned string and overlies the rebated vertical compliant area of sensitivity 222 as shown in FIG. 3C.

Second Embodiment

In a further alternative embodiment, the entire string saddle and body is divided into mechanically and electrically discrete individual saddle body segments, a separate and discrete segment supporting each string. Each discrete saddle/body segment containing all the described elements for transducer mounting, circuitry and electrical and mechanical coupling of a suspended transducer and supporting an individual tensioned string over each separate corresponding top and body portion segment. This embodiment, referred to as a string saddle "kit", comprises a plurality of individual string saddle segments, each saddle segment in correspondence with a respective string of an instrument to receive vibratory energy there from. The benefits of such an arrangement are many, including the ability to individually alter the total length of each string (also known as intonation), individual string height adjustment, as well as the flexibility to install multiple string saddles and wire them individually to an output or processor for flexible signal processing. Moreover, this second embodiment allows for additional flexibility as the discrete individual saddle body segments of the kit are replaceable, and the individual saddle segments could be customized by a luthier for different intonation setups as needed.

Figure 4:
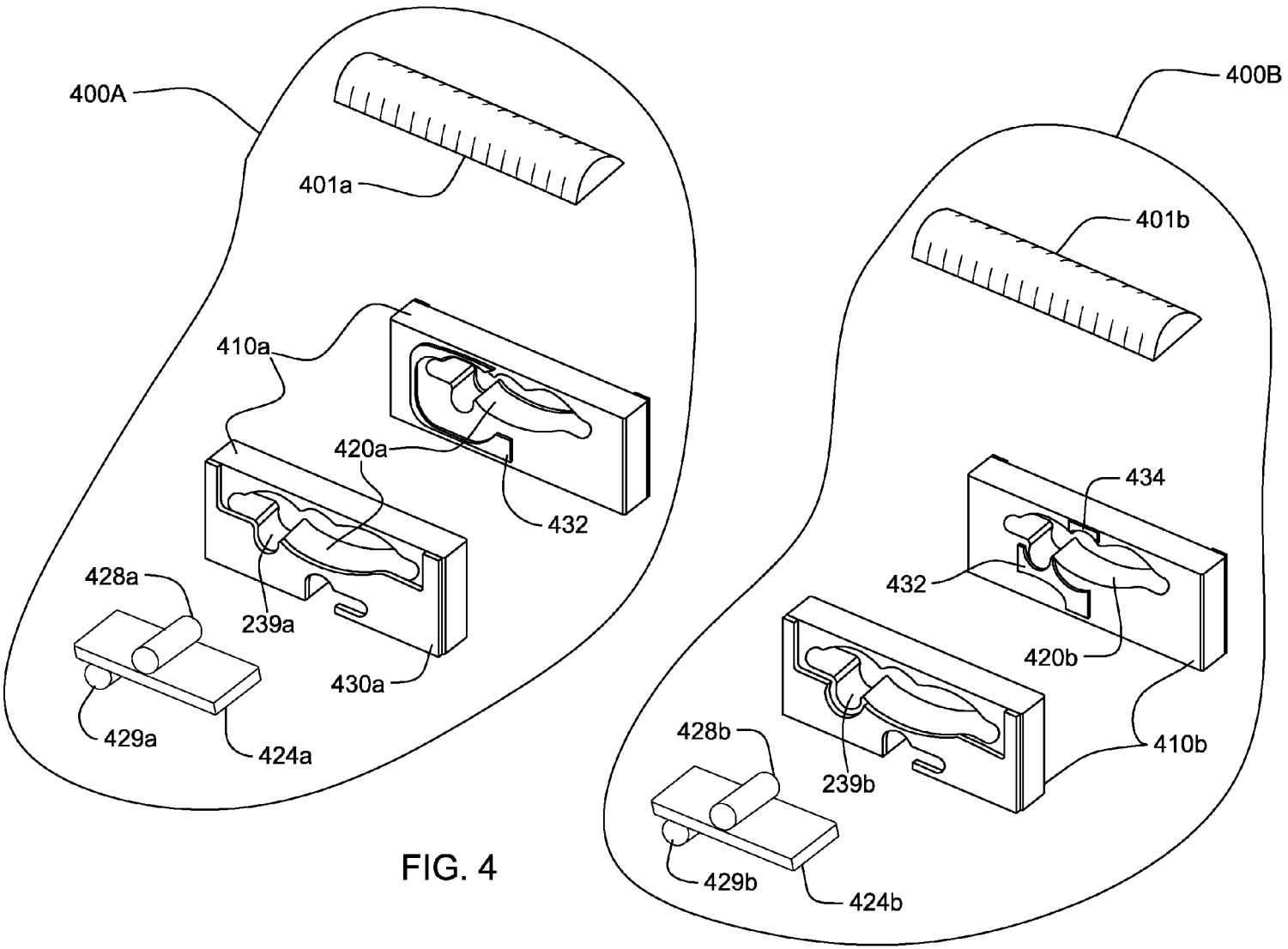
FIG. 4 shows individual transducer saddle systems with alternating phase circuits, according to an exemplary embodiment of the present invention.

FIG. 4 shows the configuration of a string saddle kit according to this embodiment of the present invention. In FIG. 4, exploded views of two individual string saddle systems are shown—although it is understood that a plurality of separate individual top saddle strip segments would be implemented in corresponding alternating manner in accordance with the number of strings of a multi-stringed instrument as described herein with respect to the unitary saddle system. In FIG. 4, saddle system 400A comprises body portions 410A that each have their outer surfaces laminated with ground plane 430A and inside surface of at least one portion laminated with positive circuit path 432 in a manner as described with respect to cavity 221 of FIG. 2. Cavity 420A houses transducer element 424A, which is mechanically and electrically coupled to the top and bottom surfaces of cavity 420A by conductive elastomer pads 428A and 429A, respectively. Aside from mechanically coupling the top surface of transducer 424A to the vertically compliant area of cavity 420A, pad 428A further electrically couples transducer 424A to positive circuit path 432. Further, bottom pad 429A electrically couples the bottom surface of transducer 424A to ground plane 430A via containment structure 239*a*, which includes an exposed conductive connection point. An individual saddle strip 401A is coupled to the top surface of body portions 410A, when sandwiched together, to support a vibrating string above saddle strip 401A and transmit vibratory energy there form to the vertically compliant area, and therefore to transducer 424A.

Similarly, saddle system 400B comprises body portions 410B that have their outer surfaces laminated with ground plane 430B. Unlike saddle system 400A, however, one or both body portions 410B have an inside surface portion provided (e.g., laminated) with a top conductive portion that connects with negative circuit path 434 via a top ground plane. Further, the inside surface of at least one body portion is laminated with positive circuit path 432 that is situated for contacting a bottom surface of transducer element within the cavity in a manner as described with respect to cavity 220 of FIG. 2. That is, the embedded circuits of the kit segments in this embodiment do make the same connections as the unitary saddle embodiment. The adjacent segments alternately phased circuits alternately connect the top of one transducer to positive and the adjacent segment will connect the top of its respective transducer to negative. As it occurs in the unitary saddle, only alternating segments have top negative embedded circuit paths to the top ground plane.

Referring still to FIG. 4, cavity 420B houses transducer element 424B, which is mechanically coupled to the top and bottom surfaces of cavity 420B by conductive elastomer pads 428B and 429B, respectively. Again, unlike saddle system segment 400A, pad 428B electrically couples top surface of transducer 424B to negative circuit path 434. Further, bottom pad 429B electrically couples the bottom surface of transducer 424B to the embedded positive circuit path 432. An individual saddle strip 401B is coupled to the top surface of body portions 410B when sandwiched together to support a vibrating string above saddle strip 401B and transmit vibratory energy there form to the vertically compliant area, and therefore to transducer 424B.

A plurality of individual saddle systems 400A and 400B may be arranged on a stringed instrument in an alternating manner. The individual transducer signal paths would thus couple electrical signals of alternating phase relationships to avoid phase cancellation effects between the adjacently disposed transducer elements as in the unitary saddle design.

The individual, single cavity saddle systems each have their own cable with a positive and negative lead. For example, for each individual saddle segment, a single shielded connector cable may provide isolated signal output from each respective string saddle segment. The shielded connector cable including a positive polarity output cable connection for soldered connection to the embedded second conductor at an internal connecting point, and, a ground output cable connection for soldered connection to an external circuit soldering point on the external ground plane of an outside body surface of the saddle segment. The solder attach positions are at the bottom of the back face of each saddle. The individual saddle cables can all be either wired together externally or each saddle output can be run individually to a separate channel in a multi channel pre amp, wherein a separate preamplifier enables individual processing of a respective string's discrete output. This would provide additional flexibility in adjusting individual volumes for each string as well as polyphonic output for applications such as MIDI interface to a polyphonic synthesizer module. The individual cables' respective contact points may be incorporated into the body portion of the musical instrument, in the form of a notched slot or like recess for receiving a plurality of dual-polarity output connector to transmit the signal via an instrument cable adapted to receive signals from the plurality of saddle systems.

Saddle Plate

FIG. 6 shows a unitary string saddle system placed within a saddle plate slot, according to an exemplary embodiment of the present invention. Saddle system 501 rests snugly within slot 561 in saddle plate 560. Saddle plate 560 is coupled to the top surface of the instrument or to a more elaborate bridge arrangement that may be adjustable in terms of height and/or Y direction, to adjust intonation. The bridge may further be coupled to a tremolo or similar floating bridge arrangement such as a Bigsby™ or Floyd Rose™. Thus, saddle plate 560 provides an interface between the saddle system 501 and the musical instrument. Further, as described above, the rebated areas prevent the sensitized areas of the structure of the cavity 520 from contacting the sides of the slot 561. This prevents the sensitized areas 520 from being mechanically damped by being forced against the walls of the saddle slot 561 from the forward pressure from the tensioned strings. Additionally, the saddles can also be free standing on the top surface of an instrument and will function without being mounted in a saddle slot.

FIG. 6 more particularly depicts the guitar saddle situated in an elongated slot. The saddle is held in the slot by the tensioned strings that run across its top surface. The saddle is typically a few thousandths of an inch undersize in width than the slot. The forward pressure of the tensioned strings pulls the saddle forward against the front wall of the slot. The rebated areas on the front and back surfaces of the saddle on each of the vertically compliant areas provides clearance between the saddle wall and the areas of sensitivity in the compliant areas. The rebated areas are machined pockets in the front and back faces of the saddle. The clearances could also be achieved by the use of shims on the front and back walls of the saddle instead of machined pockets.

FIG. 7 depicts a cross-sectional view of the saddle body 600, which may be of unitary structure, that is situated for mounting within a mounting slot 660 including opening 661 formed at a surface of the multi-stringed musical instrument, or, in a saddle mounting plate (not shown) mounted at the multi-stringed instrument surface. Note the highlighted rebate areas 602*a, b*, which depict the clearance of the vertically compliant area with the slot (instrument) wall 701.

While the invention has been particularly shown and described with respect to illustrative and preformed embodiments thereof, it will be understood by those skilled in the art that the foregoing and other changes in form and details may be made therein without departing from the spirit and scope of the invention which should be limited only by the scope of the appended claims.

The invention claimed is:

1. A string saddle system for a multi-stringed instrument comprising:

a top saddle portion spanning all tensioned strings of said multi-stringed instrument to support the tensioned strings and to receive vibratory energy therefrom;

a body portion beneath said top saddle portion having a top and opposing surfaces, and having a plurality of integral cavities, each integral cavity in correspondence with a respective string to define a plurality of vertically compliant areas of sensitivity beneath each string within the saddle, each vertically compliant area of sensitivity extending vertically from said top surface of said body portion including the top saddle portion above the cavity beneath said respective string to said corresponding cavity structure and extending horizontally according to a length of said integral cavity, a flexurally responsive transducer element suspended in and mechanically coupled to each integral cavity at mechanical coupling points, said transducer element for converting vibratory energy from the respective string to an electric signal, said vertically compliant area conveying vibrations of the respective string to said suspended transducer element via a mechanical coupling point located within each respective integral cavity structure;

a first conductor formed on said top surface and on each opposing surface of said body portion; and, a second conductor embedded within said body portion, said first conductor formed on said top and opposing body surfaces and said embedded second conductor having respective portions extending to each said integral cavity structure to provide exposed electrical contact areas at a cavity surface defining electrical coupling points for electrically connecting the transducer element to said first and second conductors at each respective said integral cavity structure such that said transducer element of adjacent integral cavities couple electrical signals of alternating phase relationships.

2. The string saddle system as claimed in claim 1, wherein a length defined between opposite side edges of each said integral cavity below each string is optimized to adjust the degree of vertical sensitivity for a respective cavity/vertically compliant area of sensitivity and enabling passive electro mechanical balancing of string outputs relative to each other.

3. The string saddle system as claimed in claim 1, wherein each said integral cavity below each string comprises elongated slot portions at opposite sides of a cavity, said elongated portions extending beyond a cavity side edge at a length optimized to adjust the degree of vertical sensitivity for a respective cavity/vertically compliant area of sensitivity and enabling passive electro mechanical balancing of string outputs relative to each other.

4. The string saddle system as claimed in claim 1, wherein said first conductor formed on said top surface and each opposing surface of said body forms a ground plane, said formed ground plane shielding said embedded second conductor.

5. The string saddle system as claimed in claim 4, wherein said first and second conductors includes a deposited or formed layer or laminate of metal material.

6. The string saddle system as claimed in claim 4, wherein said first and second conductors includes a conductive coating material such as conductive ink or epoxy.

7. The string saddle system as claimed in claim 1, wherein said first conductor includes portions connecting a top surface location of said transducer element at first electrical coupling points inside of first alternate integral cavity structures, and, said second conductor embedded within said body portion for connecting a bottom surface location of said transducer element at second electrical coupling points inside of said first alternate integral cavity structures;

said second conductor further including portions for connecting a top surface location of said transducer element at first electrical coupling points inside of second alternate integral cavity structures;

said first conductor further including portions extending from said top surface for connecting a bottom surface location of said transducer element at second electrical coupling points inside of said second alternate integral cavity structures.

8. The string saddle system as claimed in claim 7, further comprising:

a conductive coupling means provided at respective said first electrical coupling points and second electrical coupling points for electrically coupling respective top surface and bottom transducer surfaces of said suspended transducer element in said integral cavity to said first and second conductors via respective said exposed electrical contact areas within each said integral cavity structure.

9. The string saddle system as claimed in claim 8, wherein said mechanical coupling points in said cavity are co-located with both said first electrical and second electrical coupling points within the integral cavity, wherein said conductive coupling means at first electrical coupling points further simultaneously mechanically couple said transducer element to said vertically compliant area of sensitivity.

10. The string saddle system as claimed in claim 9, wherein said conductive coupling means comprises a flexible conductive elastomer material.

11. The string saddle system as claimed in claim 10, further comprising:

a containment structure formed and located at each said second electrical coupling points within an integral cavity having respective said exposed said electrical contact areas, said flexible conductive elastomer material being compressively engaged within a respective containment structure formed at said second electrical coupling points.

12. The string saddle system as claimed in claim 11, further comprising:

a coating of conductive paint at a surface of each said electrically indexed containment structure to increase the conductive surface area between each first and second conductor and a respective said flexible conductive elastomer material, wherein, for said second electrical coupling points at said second alternate integral cavity structures, said conductive paint extending within said electrically indexed containment structure to contact the first conductor on said opposing body surfaces.

13. The string saddle system as claimed in claim 11, further comprising:

a coating of conductive paint at a surface of said top ramped roof structure for increasing the conductive surface area between each first electrical coupling point and a respective said flexible conductive elastomer material situated in compression.

14. The string saddle system as claimed in claim 10, wherein said flexible conductive elastomer material comprises extruded conductive rubber.

15. The string saddle system as claimed in claim 10, wherein each said integral cavity below each string comprises a top ramped roof structure below its respective vertically compliant area of sensitivity, said top ramped roof structure including said exposed electrical contact area at said first electrical coupling point, wherein said flexible conductive elastomer material is situated in compression between said a top surface of said suspended transducer element and said first electrical coupling point of said top ramped roof structure.

16. The string saddle system as claimed in claim 15, wherein said compression mounted flexible conductive elastomer material compresses said transducer element to thereby anchor said transducer element suspended within a respective cavity by exerting pressure on the transducer element suspended on and one or more mounting ledge formations formed on a bottom surface of each said integral cavity structure, said transducer responding to a relative differential in mechanical input between said mechanical coupling to the defined area of sensitivity via said conductive elastomer material, and said at least one of said one or more mounting ledge formations to produce said electrical signals by flexural deformation as a result of mechanical vibrations from the vibrating string being imparted to the suspended transducer via the vertically compliant area and the conductive elastomer material at said first electrical coupling point.

17. The string saddle system as claimed in claim 16, wherein said flexible conductive elastomer material is provided at a second coupling point to provide said electrical coupling to said electrical exposed contact area within the cavity and additionally provides a soft ledge support of said suspended transducer element in compression.

18. The string saddle system as claimed in claim 17, wherein said flexible conductive elastomer material provided at said first and second electrical coupling points extend within the cavity structure transverse with respect to the length of the body portion, said said first conductor formed on said opposing body surfaces includes one or more rebated portions at areas corresponding to said provided flexible conductive elastomer material structures formed in each cavity to thereby isolate the transverse conductive elastomer pad material and prevent a short circuit between the second conductor and the first conductor on said outside surface.

19. The string saddle system as claimed in claim 18, wherein said one or more rebated portions of said first conductor formed on said opposing body surfaces correspond to locations of said first electrical coupling points inside of second alternate integral cavity structures.

20. The string saddle system as claimed in claim 19, wherein said first conductor formed on outside surfaces functions is a shaped conductive shim bonded to the body portion surface, said conductive shim being copper or brass.

21. The string saddle system as claimed in claim 16, wherein said top ramped roof structure enables adjusting a degree of compression of the flexible conductive elastomer material between the vertically compliant area and the transducer, said degree of compression affecting a degree of mechanical coupling between the vertical compliant area and transducer to thereby adjust relative outputs from string to string and to adjust overall string output balances.

22. The string saddle system as claimed in claim 9, wherein said conductive coupling means comprises a predetermined amount of conductive adhesive material.

23. The string saddle system as claimed in claim 22, wherein said conductive adhesive material comprises one of: a conductive rubber glue or soft cure conductive epoxy of suitable viscosity and durometer.

24. The string saddle system as claimed in claim 9, further comprising:

one or more mounting ledge formations formed on a bottom surface of each said integral cavity structure for enabling mounting of a transducer element in one of beam suspension or cantilever suspension within said integral cavity, wherein a formed mounting ledge includes an contact area for electrical coupling as a second electrical coupling point.

25. The string saddle system as claimed in claim 10, wherein said compression mounted flexible conductive elastomer material compresses said transducer element to thereby anchor said transducer element suspended within a respective cavity by exerting pressure on the transducer element suspended on two or more soft ledge formations formed on a bottom surface of each said integral cavity structure, said transducer responding to a relative differential in mechanical input between said mechanical coupling to the defined area of sensitivity via said conductive elastomer material, and said two soft ledge formations, said transducer element producing said electrical signals by flexural deformation as a result of mechanical vibrations from the vibrating string being imparted to the suspended transducer via the vertically compliant area and the conductive elastomer material at said first electrical coupling point.

26. The string saddle system as claimed in claim 25, wherein said two or more soft ledge formations each comprise said flexible conductive elastomer material located beneath said transducer element, one of said flexible conductive elastomer materials being located at a second electrical coupling point within the integral cavity structure.

27. The string saddle system as claimed in claim 9, wherein a stringed instrument provides an opening in which said string saddle system is mounted, each said opposing body surface of the saddle is rebated at said compliant areas of sensitivity, to provide clearance between the compliant areas of sensitivity and the edges of said stringed instrument opening for mounting said saddle system therein.

28. The string saddle system as claimed in claim 27, further comprising:

a saddle plate situated within said opening for coupling said string saddle to said multi-stringed instrument.

29. The string saddle system as claimed in claim 9, wherein a stringed instrument provides an opening in which said string saddle system is mounted, said saddle system further comprising:

a shim structure provided at each said opposing body surface of the opening, said shims on the outside body surfaces to provide the clearance between the compliant areas of sensitivity and the edges of said stringed instrument opening for mounting said saddle system therein.

30. The string saddle system as claimed in claim 9, wherein said string saddle is mounted above a surface of said multi-stringed instrument.

31. The string saddle system as claimed in claim 7, further comprising:

a cable mounting pocket extending from a bottom surface of the body portion to expose an internal circuit soldering point for coupling a connector cable to said embedded second conductor at said internal connecting point; and, a connector cable received within said cable mounting pocket and having a positive polarity output cable connection for soldered connection to said embedded second conductor at said internal connecting point.

32. The string saddle system as claimed in claim 31, further comprising:

an opening at one end of the saddle body portion for routing a ground output cable connection of said connector cable for soldered connection to an external circuit soldering point on said external ground plane of said exterior outside saddle body surface.

33. The string saddle system as claimed in claim 32, wherein output cable connector couples said transducer electrical signal to one of: a high impedance pre-amplifier device, an amplifier device, a signal processing circuit.

34. The string saddle system as claimed in claim 7, wherein said body portion comprises two laminated circuit boards, said first conductor comprising a metal laminate layer on opposing outer surface of each said circuit board, and said second conductor comprising a metal laminate layer formed on an inner surface of one circuit board.

35. The string saddle system as claimed in claim 34, wherein each said body portion comprises:

indexing pin holes extending through said laminated plates of said body portion for precision alignment of said second conductor to coupling points in said integral cavity structures.

36. The string saddle as claimed in claim 7, wherein said body portion comprises a circuit board stack having two circuit board layers, said first conductor comprising metal layers on opposing outside surfaces of each circuit board layer and said second embedded conductor layer sandwiched there between.

37. The string saddle system as claimed in claim 1, wherein said top saddle portion and body portion comprise a single unitary structure.

38. The string saddle system as claimed in claim 1, wherein top saddle portion spanning all tensioned strings of said multi-stringed instrument comprises individual top saddle segments over a unitary saddle body portion.

39. A string saddle for a stringed musical instrument comprising:

a top saddle portion spanning one or more tensioned strings of said stringed musical instrument to support the tensioned strings and to receive vibratory energy therefrom;

a body portion beneath said top saddle portion having a top and opposing surfaces, and having a respective one or more integral cavities, each integral cavity in correspondence with a respective string to define a respective one or more vertically compliant areas of sensitivity beneath each string within the saddle, each vertically compliant area of sensitivity extending vertically from said top surface of said body portion including the top saddle portion above the cavity beneath said respective string to said corresponding cavity structure and extending horizontally according to a length of said integral cavity, a flexurally responsive transducer element suspended in and mechanically coupled to each integral cavity at mechanical coupling points, said transducer element for converting vibratory energy from the respective string to an electric signal, said vertically compliant area conveying vibrations of the respective string to said suspended transducer element via a mechanical coupling point located within each respective integral cavity structure;

a first conductor formed on said top surface and on each opposing surface of said body portion; and, a second conductor embedded within said body portion, said first conductor formed on said top and opposing body surfaces and said embedded second conductor having respective portions extending to each said integral cavity structure to provide exposed electrical contact areas at a cavity surface defining electrical coupling points for electrically connecting the transducer element to said first and second conductors at each respective said integral cavity structure.

* * * * *